US005477795A

United States Patent [19]

Nakayama et al.

[11] Patent Number: 5,477,795

[45] Date of Patent: Dec. 26, 1995

[54] THREAD TRIMMING DEVICE FOR A LOCKSTITCH BAR TACKING SEWING MACHINE

[75] Inventors: Koichi Nakayama, Tochigi; Katsuo Hiratsuka, Haga; Masanori Ayuta, Tochigi, all of Japan

[73] Assignee: The Singer Company N.V., Curaco, Netherlands Antilles

[21] Appl. No.: 194,198

[22] Filed: Feb. 9, 1994

[30] Foreign Application Priority Data

Jul. 16, 1993 [JP] Japan ..... 5-043595 U

[51] Int. Cl.[6] ..... D05B 65/02; D05B 69/36

[52] U.S. Cl. ..... 112/277; 112/291; 112/300

[58] Field of Search ..... 112/285, 291, 112/293, 296, 300, 301, 277, 271

[56] References Cited

U.S. PATENT DOCUMENTS 3,859,940 1/1975 Nakamura ..... 112/296

5,009,177 4/1991 Sato et al. ..... 112/291 X 5,146,862 9/1992 Sato et al. ..... 112/300 X

*Primary Examiner*—Paul C. Lewis

*Attorney, Agent, or Firm*—McCormick, Paulding & Huber

[57] ABSTRACT

A thread trimming device for a lockstitch bar tacking sewing machine is equipped with a thread trimming unit comprising a detecting member which is rotatably supported by a sewing machine body and has a detecting portion, a first position detecting means which is fixedly mounted on said sewing machine body in such a way as to be capable of facing the detecting portion of the detecting member and which produces a thread trimming signal for starting thread trimming when the detecting portion approaches thereto and a driving unit for driving a thread trimming cam link in such a way as to bring the contact portion of a thread cam link in contact with the cam surface of a thread trimming cam for trimming a needle and a bobbin threads based on the thread trimming signal. As a result, the mechanical components thereof becomes simple in structure and easy in adjustment, and those relating to the thread trimming operation are improved in durability. The torque of an arm shaft is reduced and equalized, so that it is possible to equalize a stitch pattern and finish a well-balanced sewn product.

2 Claims, 7 Drawing Sheets

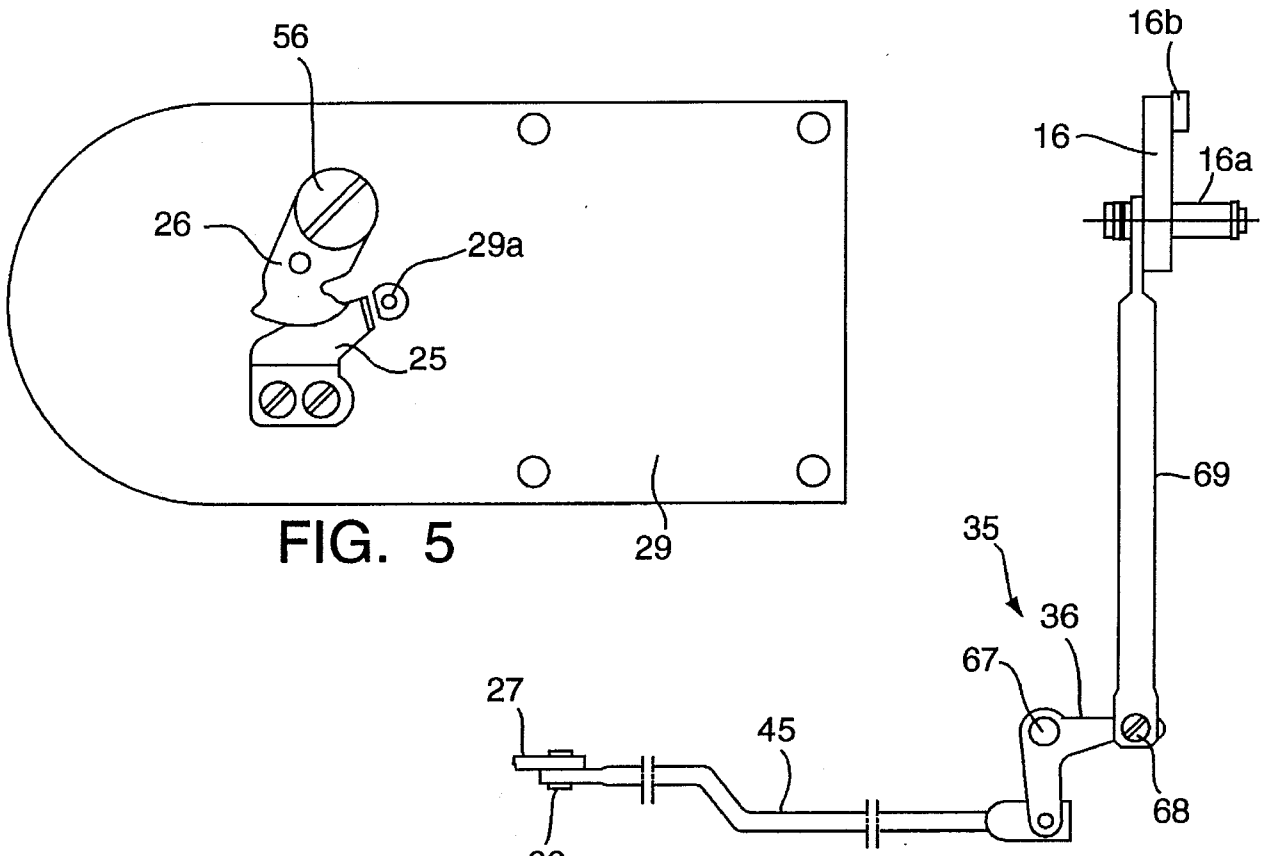
FIG. 7
FIG. 5
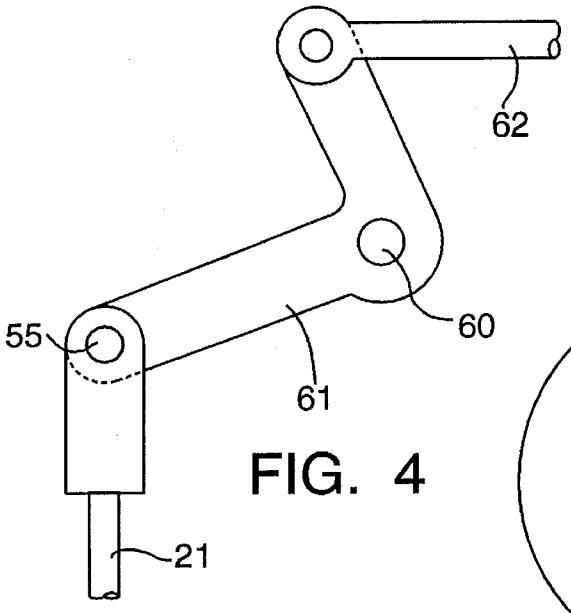
FIG. 4

THREAD TRIMMING DEVICE FOR A LOCKSTITCH BAR TACKING SEWING MACHINE

BACKGROUND OF THE INVENTION

1. Field of the Invention

The present invention relates to a thread trimming device for a lockstitch bar tacking sewing machine.

2. Description and Problems of the Related Art

A lockstitch bar tacking sewing machine performs a cycle of sewing operation to form a given number of stitches for bar tacking sewing, button sewing, etc., and there are known some sewing machines of this kind equipped with thread trimming devices for trimming the needle and bobbin threads upon completion of a cycle of sewing operation which corresponds to one revolution of a feed cam. Thread trimming devices of conventional sewing machines of this kind are designed to perform thread trimming by driving a movable knife provided under a throat plate to turn by way of a link equipped with a roller which follows the variation of cam surface of a thread trimming cam mounted on an arm shaft only at the last stitch during a cycle of sewing operation corresponding to a given number of stitches due to the variation of the cam surface on the side of a feed cam. The roller is connected to the movable knife by way of a mechanical link mechanism.

Whereas excepting the time for the thread trimming, i.e., excepting the time for forming the last stitch during a cycle of sewing operation, the cam surface of side surface of the feed cam coercively holds the link equipped with the roller for preventing the roller from touching the cam surface of the thread trimming cam so as to prevent the thread trimming.

Such a contact between the roller and the feed cam not only increases the torque of the arm shaft but also generate abrasion on the cam surface of the side surface of the feed cam. Moreover, since the mechanism for preventing the thread trimming during a cycle of sewing operation excepting the time of forming the last stitch is composed of the mechanical link mechanism alone, there is a technical problem that it is complicated in construction and requires much labor in adjusting operation and part exchanging operation.

SUMMARY OF THE INVENTION

The present invention has been made from a viewpoint of such conventional technical problems to provide a thread trimming device for a lockstitch bar tacking sewing machine comprising an arm shaft 9 which is driven to rotate by a driving motor 5 and is rotatably supported by a sewing machine body 30, a thread trimming cam 20 which is fixed to the arm shaft 9 for stopping the rotation of the arm shaft 9 at a given position and performing thread trimming at the last stitch of a sewing cycle after a needle 7 has made a given number of stitches to complete a cycle of serving operation and a thread trimming cam link 16 which is rotatably supported by the sewing machine body 30 on the side thereof, characterized in that the thread trimming device further comprises a detecting member 10 which has a detecting portion 10*a* and is rotatably supported by the sewing machine body 30 and which is driven to rotate at a reduced speed by the arm shaft 9, the detecting member 10 interlocking the arm shaft 9, so as to make one revolution during a cycle of sewing operation, a first position detecting means 12 which is fixedly mounted on the sewing machine body 30 in such a way as to be capable of facing the detecting portion 10*a* of the detecting member 10 and which produces a speed switching signal when the detecting portion 10*a* approaches thereto, a second position detecting means 12 which is fixedly mounted on the sewing machine body 30 in such a way as to be capable of facing the detecting portion 10*a* of the detecting member 10 and which produces a thread trimming signal for starting the thread trimming when it detects the detecting portion 10*a* at the last stitch of a sewing cycle, an arm shaft rotating speed control unit 23 for controlling the rotating speed of the arm shaft 9 by varying the rotating speed of the driving motor 5 based on the speed switching signal produced by the first position detecting means 12 and a thread trimming unit 44 comprising a driving unit 50 for driving a thread trimming cam link 16 so that the same may come in contact with a cam surface 20*a* of the thread trimming cam 20 at a contact portion 16*b* thereof for trimming needle and bobbin threads.

The thread trimming unit 44 can have a movable knife 26 which is driven to turn by way of turning the thread trimming cam link 16 and a stationary knife 25 which is fixedly mounted on the sewing machine body 30.

In such a thread trimming device for a lockstitch bar tacking sewing machine, a thread trimming signal is produced as the detecting portion 10*a* of the detecting member 10 approaches the second position detecting means 12 at the last stitch of a sewing cycle, and the thread trimming unit 44 starts trimming based on the thread trimming signal. That is, the driving unit 50 operates to drive the thread trimming cam link 16 so that the contact portion 16*b* thereof may be brought in contact with the cam surface 20*a* of the thread trimming cam 20 based on the thread trimming signal. Since the thread trimming cam 20 fixed to the arm shaft 9 rotates together with the arm shaft 9 at the last stitch of a sewing cycle, the thread trimming cam link 16 is turned according to the cam surface 20*a*. It is possible to operate the thread trimming unit 44 to trim the needle and bobbin threads by turning the thread trimming cam link 16.

In case the thread trimming unit 44 is equipped with a movable knife 26 which is driven to turn by the turning of the thread trimming cam link 16 and a stationary knife 25, the movable knife 26 is driven to turn by turning the thread trimming cam link 16 so as to trim the needle and bobbin thread cooperating with the stationary knife 25.

BRIEF DESCRIPTION OF THE DRAWINGS

FIG. 4 is a rear view showing a bell crank in FIG. 1;

FIG. 5 is a bottom view showing a movable and a stationary knives in FIG. 1;

FIG. 7 is a front view showing a link mechanism between the movable knife and a thread trimming cam link;

PREFERRED EMBODIMENT OF THE INVENTION

An embodiment of the present invention will be described hereinafter.

Figure 1:
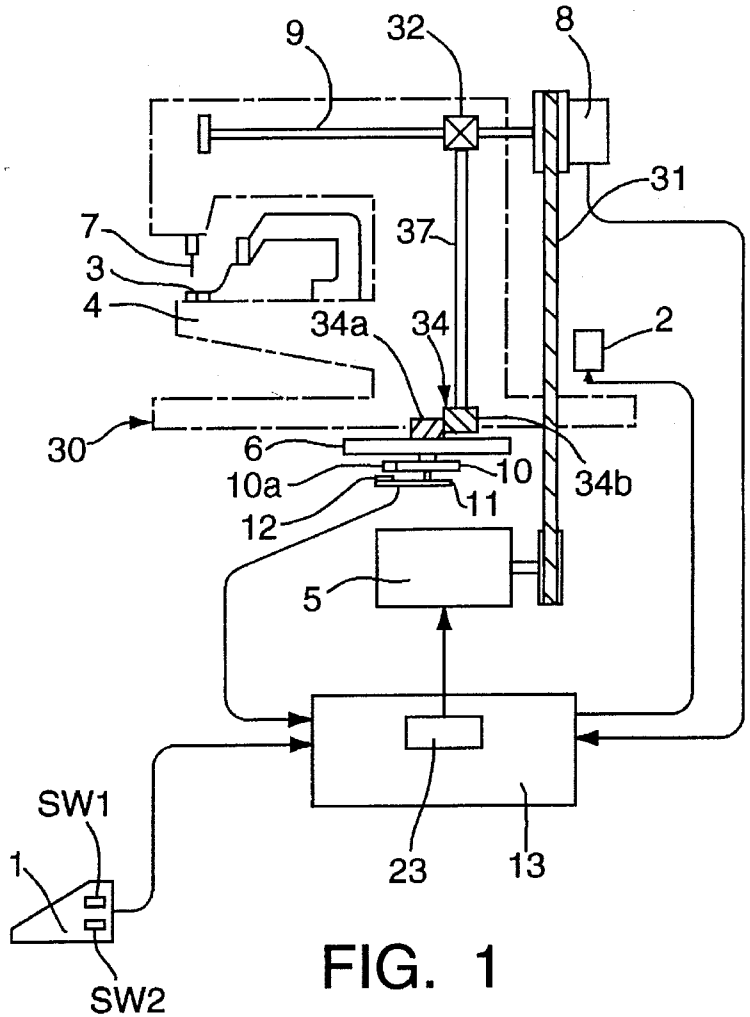
FIG. 1 is a front view showing an outline of a lockstitch bar tacking sewing machine equipped with a thread trimming device according to an embodiment of the present invention.
Figure 9:
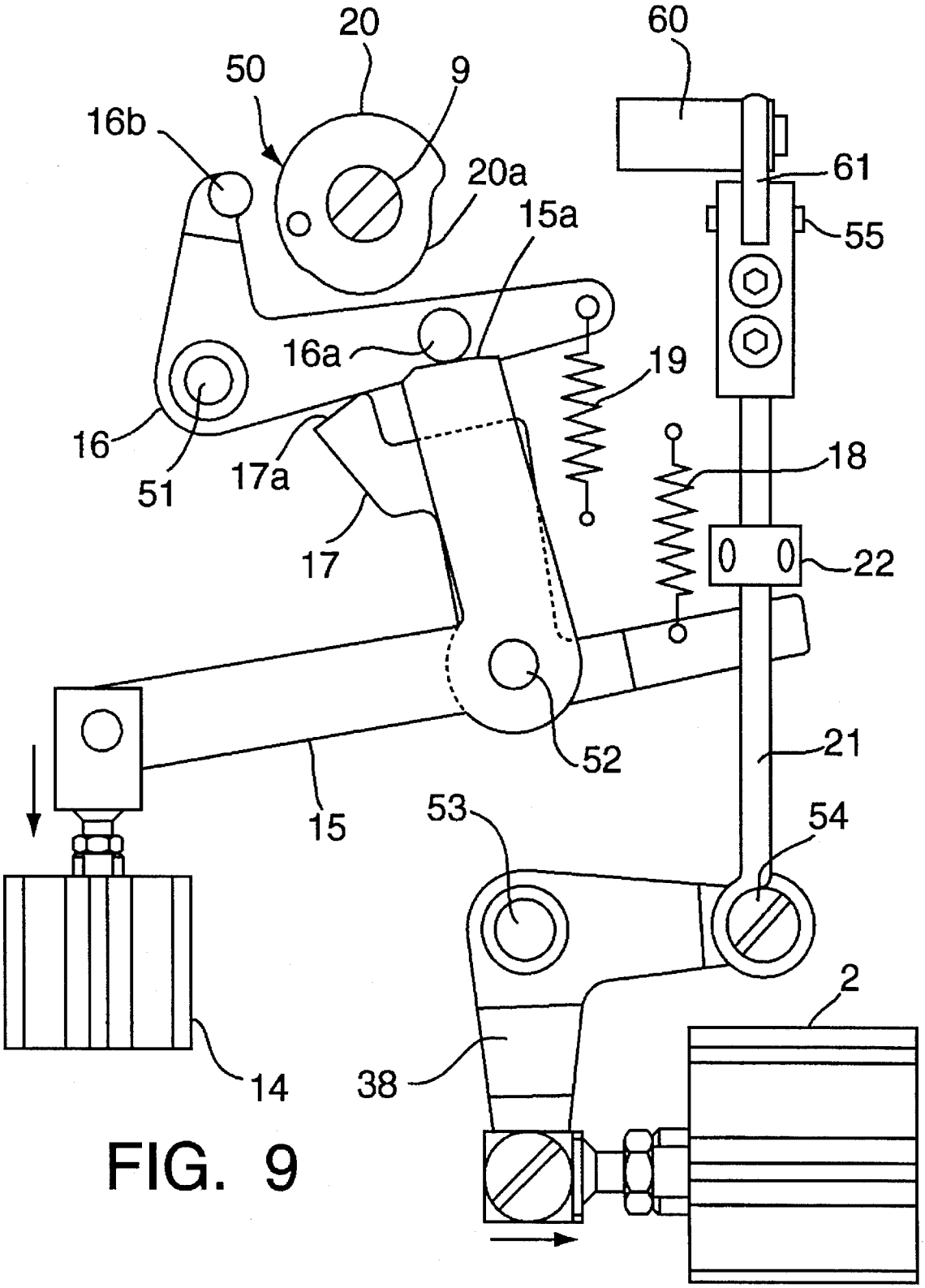
FIG. 9 is a view for explaining the operation of the thread trimming device in FIG. 1.
Figure 10:
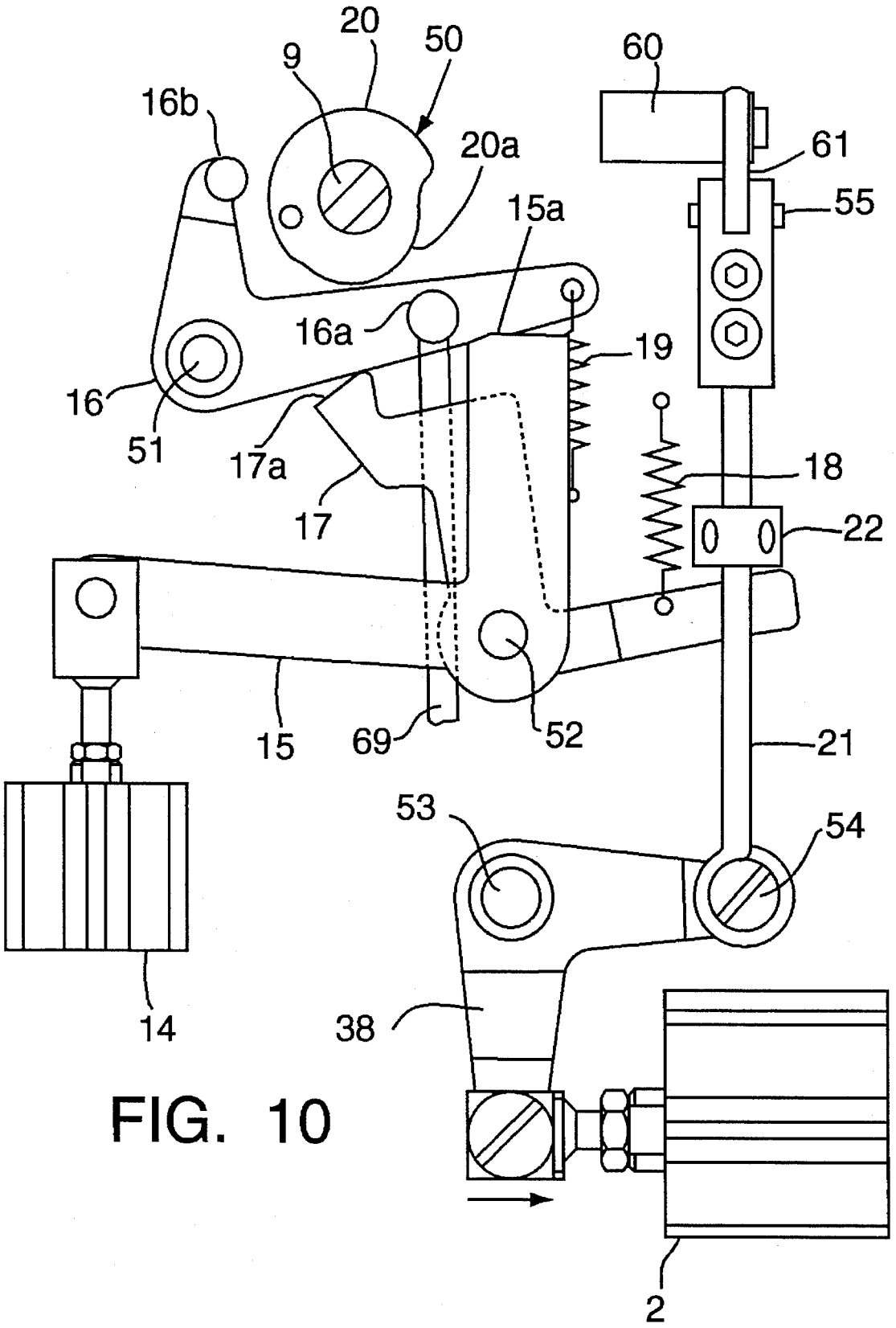
FIG. 10 is a view for explaining the operation of the thread trimming device in FIG. 1.
Figure 11:
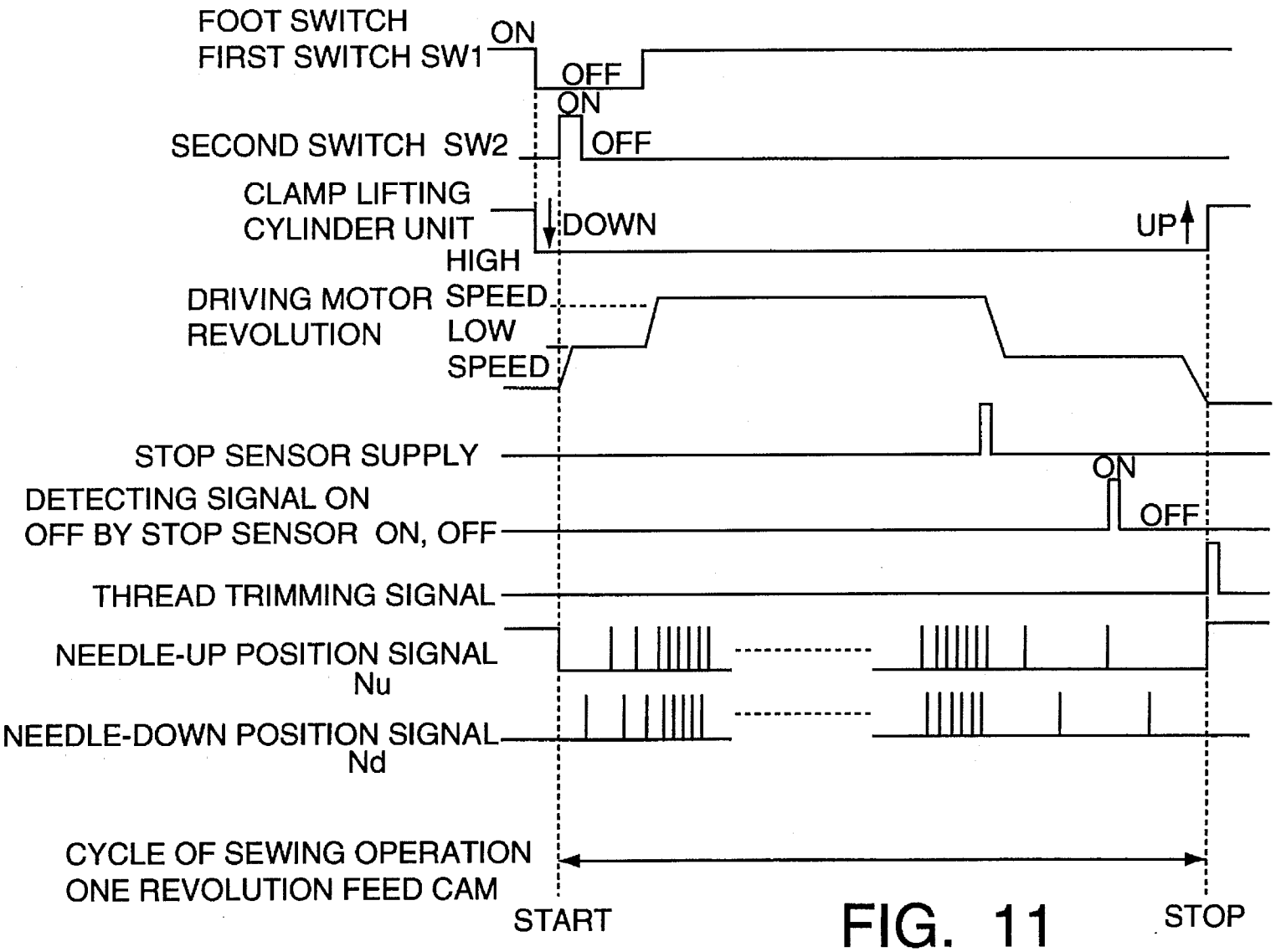
FIG. 11 is a timing chart showing the waveforms of various signals during a cycle of sewing operation in FIG. 1.

FIGS. 1 to 11 show an embodiment of the present invention. In the figures, denoted at 30 is a sewing machine body, and a needle position detector 8 including a tachometer generator (generator type speedometer) is provided at an end portion of an arm shaft 9 which is rotatably supported by the sewing machine body 30 as illustrated in FIG. 1 for detecting the position of a needle 7 which is driven by the arm shaft 9 by detecting the turning angle of the arm shaft 9 and successively producing needle-up position signals Nu and needle-down position signals Nd and resultant signals representing the number of stitches as illustrated in FIG. 11.

Figure 2:
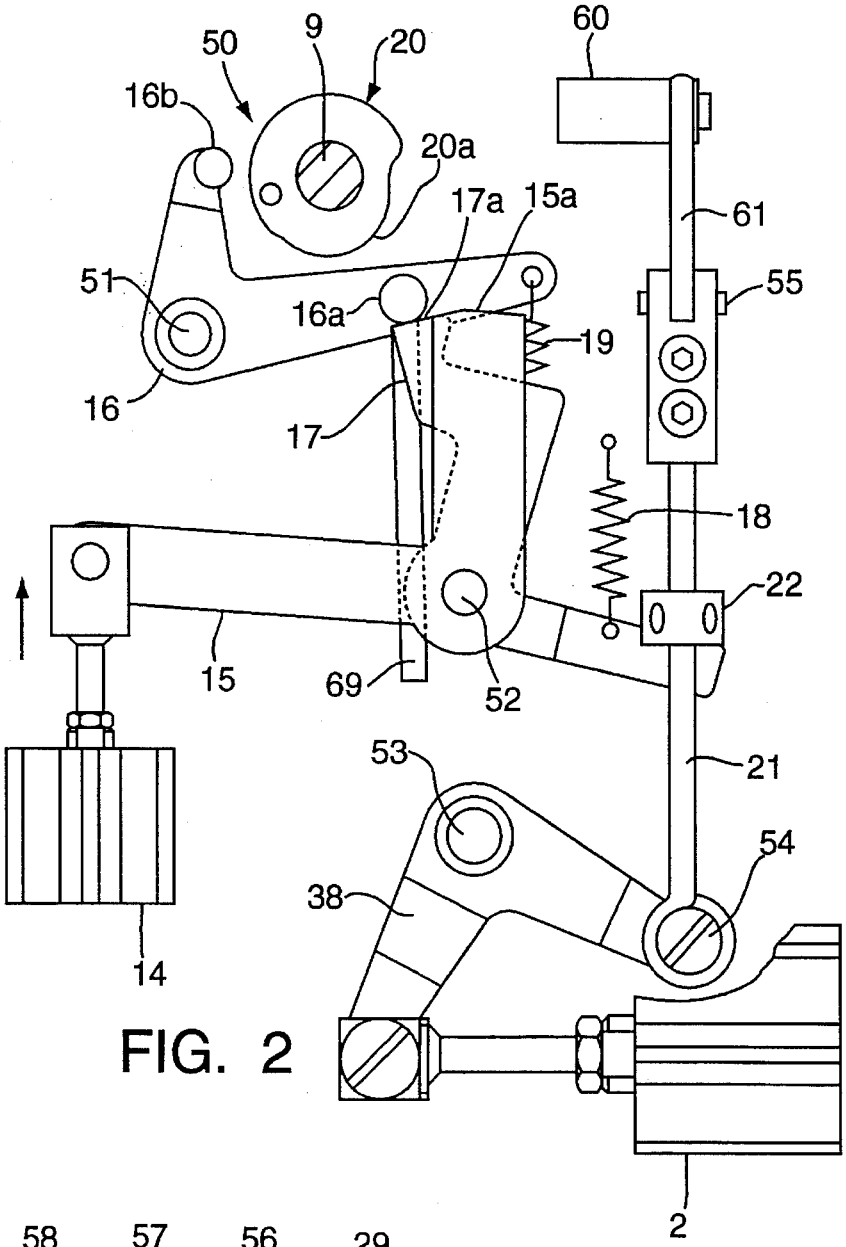
FIG. 2 is a side view showing a main part of the thread trimming device in FIG. 1.

In FIG. 1, denoted at 13 is a control box having a microcomputer therein, which receives a detecting signal of a stepping position corresponding to the stepping amount of a foot switch 1, a detecting signal produced by the needle position detector 8, a speed switching signal produced by a stop sensor 12 which serves as a first and a second position detecting means and a thread trimming signal and which produces an electric signal for controlling a thread trimming releasing cylinder unit 14 and a clamp lifting cylinder unit 2 which are illustrated in FIG. 2 or controls the rotating speed of a driving motor 5 on the basis of these signals.

The driving motor 5 which drives the arm shaft 9 to rotate by way of a belt transmission system 31 is composed of a servomotor which is excellent in the characteristics of speed-up, speed-down and inching in rotation. The foot switch 1 is composed of a first switch SW1 and a second switch SW2 which operate according to the stepping amount thereof, and the first switch SW1 produces a signal when it is turned off while the second switch SW2 produces a signal when it is turned on as illustrated in FIG. 11.

Denoted at 10 is a disc-shaped detecting member, which is fixed to the feed cam gear **34*a* of a second gear system 34 coaxially with a feed cam 6 and is rotated at a given reduction gear ratio by the arm shaft 9 by way of a pair of first and second gear systems 32 and 34 and a cam driving shaft 37. The cam driving shaft 37 is rotatably supported by the sewing machine body 30. The feed cam 6 having a function of forming a given stitch pattern having a given number of stitches on a sewn product cooperating with a cloth clamp foot 3 on a sewing machine bed 4** makes one revolution in a cycle of sewing operation.

The first gear system 32 is composed of a worm fixed to the arm shaft 9 and a worm wheel fixed to the cam driving shaft 37. The second gear system 34 is composed of a cam driving gear **34*b* and a feed cam gear 34*a* engaging therewith, the cam driving gear 34*b* being fixed to the lower end portion of the cam driving shaft 37 while the feed cam gear 34*a* being rotatably supported by the sewing machine body 30 by way of a supporting shaft, not shown. Accordingly, the detecting member 10 and the feed cam 6 are also rotatably supported by the sewing machine body 30. Moreover, a stop sensor 12 is mounted on a bracket 11 which is fixedly mounted on the side of the sewing machine body 30 so as not to be turnable. The thread trimming device is provided with at least one stop sensor 12** which serves as a first position detecting means.

Figure 3:
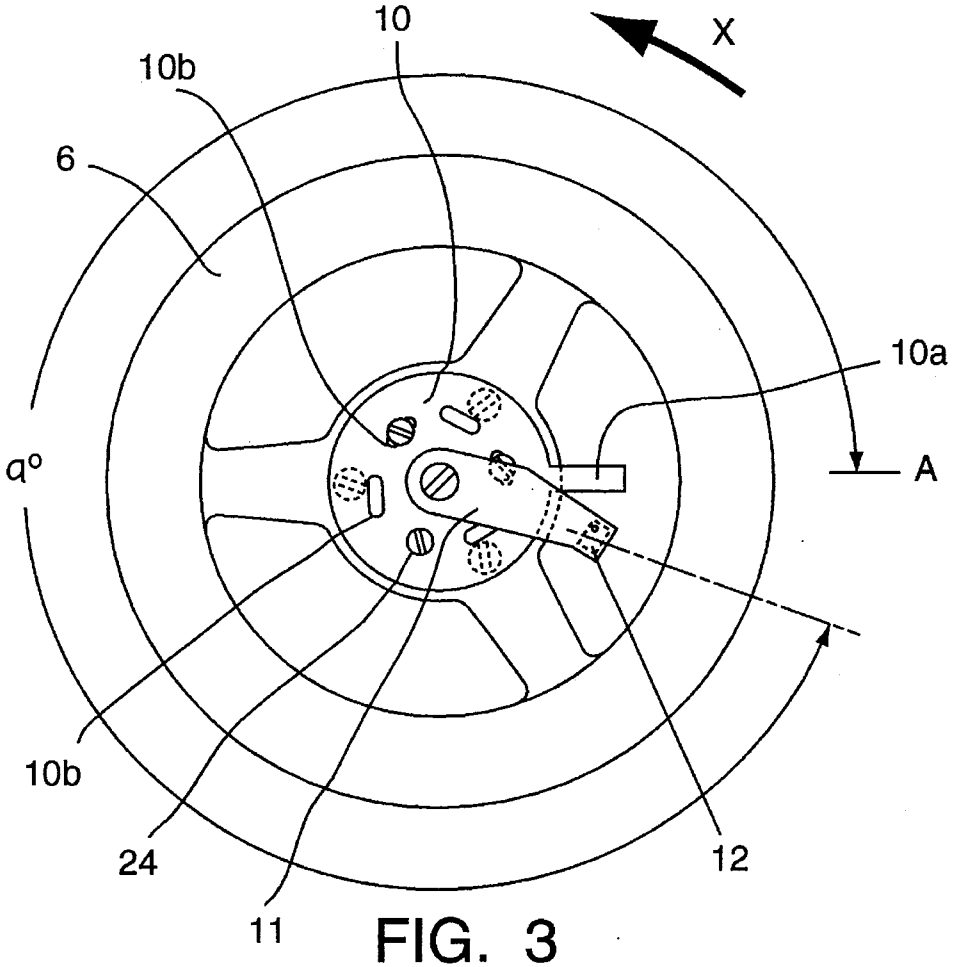
FIG. 3 is a bottom view showing a feed cam, detecting member and a stop sensor in FIG. 1.

The detecting member 10 having a disc shape comprises a tongue **10*a* serving as a detector radially projecting at a part of the outer circumference thereof and is adjustable in circumferential mounting position on the feed cam gear 34*a* as illustrated in FIG. 3. To put it concretely, the detecting member 10 comprises a plurality of long holes formed circumferentially at a given interval therein, and set screws 24 are inserted through the long holes and fixing holes formed in the feed cam 6 to be screwed into the feed cam gear 34*a* so as to enable the continuous circumferential adjustment of the detecting member 10** by changing the positions of the set screws in the long holes.

The feed cam 6 and the detecting member 10 are rotated together with the feed cam gear **34*a* at a reduced speed accompanying the rotation of the arm shaft 9 in the direction of an arrow X illustrated in FIG. 3. When the detecting member 10 which is rotated at a reduced speed by the arm shaft 9 in this way is turned from a reference point A illustrated in FIG. 3 by a set angle $\alpha°$, that is, after the needle 7 has made a given number of strokes, the stop sensor 12 which serves as the first position detecting means provided opposite to the locus of the tongue 10*a* detects the approach of the tongue 10*a* so that it supplies a detecting signal (a speed switching signal) to the control box 13** set forth above.

An arm shaft rotating speed control unit 23 in the control box 13 switches the control voltage of the driving motor 5 to that for low speed operation to control the rotating speed of the arm shaft 9 at a low speed based on the detecting signal from the stop sensor 12 and the signal (the needle-up signal Nu etc.) supplied from the needle position detector 8 and stops the driving motor 5 when the needle 7 is at the up position after a previously set and stored number of stitches have been made. In this way the rotating speed of the arm shaft 9 which is driven by way of a belt transmission system 31 is changed.

Next, a thread trimming unit 44 provided in the sewing machine body 30 will be described with reference to FIG. 2 and FIGS. 4 to 7. The thread trimming unit 44 is mainly composed of a thread trimming cam 20, a thread trimming cam link 16, the thread trimming releasing cylinder unit 14, the clamp lifting cylinder unit 2, a link mechanism 35, a movable knife 26 and a stationary knife 25.

The thread trimming cam 20 is fixed to the arm shaft 9 and has a cam surface **20*a* having a given shape on the outer periphery thereof. The thread trimming cam link 16 having an L-shape, which is rotatably supported by the sewing machine body 30 by way of a pin 51 at the central portion thereof and which comprises a first thread trimming cam roller 16*b* serving as a contact portion capable of engaging with the cam surface 20*a* at one end portion thereof and a second thread trimming cam roller 16*a* at the other end portion thereof, is always forced to turn clockwise in the figure by a spring 19 provided between the other portion thereof and the sewing machine body 30**.

A thread trimming releasing lever 15 having an L-shape is rotatably supported by the sewing machine body 30 at the central portion thereof by way of a pin 52, is connected to the piston rod of the thread trimming releasing cylinder unit 14 at one end portion thereof and has a cam surface **15*a* at the other end portion thereof, the cam surface 15*a* being formed in such a way as to be retained by a second thread trimming cam roller 16*a* when the thread trimming releasing cylinder unit 14 is contracted so that the first thread trimming cam roller 16*b* is released from engaging the cam surface 20*a* and the thread trimming cam link 16 is restrained from being turned by the spring 19 in the state wherein the cam surface 15***a* is retained by the second thread trimming cam roller 16*a*.

A thread trimming lever 17 substantially having an L-shape is rotatably supported by the sewing machine body 30 together with the thread trimming releasing lever 15 by way of a pin 52 at the central portion thereof and is always forced to turn counterclockwise in the figure by a spring 18 provided between the sewing machine body 30 and one end thereof. The thread trimming lever 17 has a cam surface 17*a* which is formed in such a way as to be retained by the second thread trimming cam roller 16*a* when the thread trimming lever 17 is turned clockwise as illustrated in FIG. 2 at the other end thereof.

Since the cam surface 15*a* of the thread trimming releasing lever 15 is projected a little further than the cam surface 17*a* of the thread trimming lever 17, the cam surface 17*a* can freely turn under the second thread trimming cam roller 16*a* while the cam surface 15*a* pushes up the second thread trimming cam roller 16*a* sufficiently. Since the biasing force to turn the thread trimming cam link 16 due to the elasticity of the spring 19 is set to be larger than the biasing force to turn the thread trimming lever 17 due to the elasticity of the spring 18, the thread trimming lever 17 does not turn by the elasticity of the spring 18 but is kept to be retained by the second thread trimming cam roller 16*a* at the cam surface 17*a* thereof when a block 22, described later, is released from engaging with the thread trimming lever 17 in the state wherein the cam surface 17*a* is retained by the second thread trimming cam roller 16*a*.

The piston rod of the clamp lifting cylinder unit 2 is connected to one end portion of a bell crank 38 by way of a pin. The bell crank 38 is rotatably supported by the sewing machine body 30 at the central portion thereof and is rotatably connected to a rod 21 which is supported by the sewing machine body 30 in such a way as to be vertically movable at the other portion thereof by way of a pin 54. A bell crank 61 is rotatably connected to the upper end portion of the rod 21 by way of a pin 55 at one end portion thereof and the bell crank 61, which is rotatably supported by the sewing machine body 30 by way of a pin 60 at the central portion thereof, is connected to a cloth clamp foot 3 to drive the same by way of a link mechanism including a link 62 at the other end portion thereof as illustrated in FIG. 4. A block 22 mounted on the rod 21 at the central portion thereof is disposed above the other end portion of the thread trimming lever 17 so as to engage the same when the clamp lifting cylinder unit 2 is contracted as illustrated in FIG. 9.

The clamp lifting cylinder unit 2, the thread trimming releasing cylinder unit 14 and the spring 19 constitutes a driving unit 50 for driving the thread trimming cam link 16 so as to bring the first thread trimming cam roller 16*b* which serves as the contact portion of the thread trimming cam link 16 in contact with the cam surface 20*a* of the thread trimming cam 20 for trimming the needle and bobbin threads.

Figure 6:
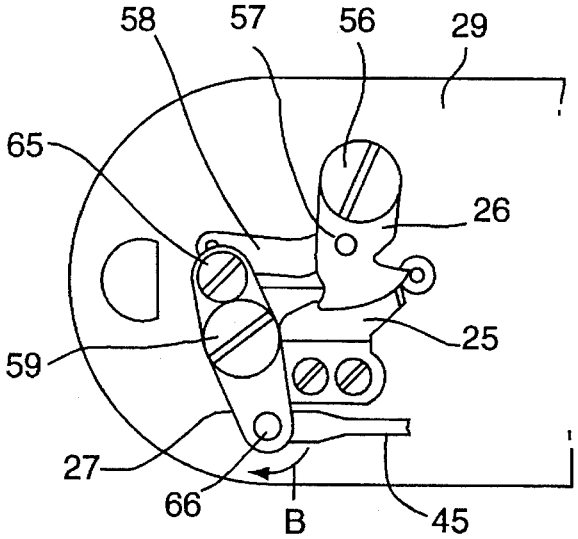
FIG. 6 is a bottom view showing the movable and stationary knives in FIG. 1.

The stationary knife 25 is fixed to the sewing machine body 30 adjacent to a needle hole 29*a* under a throat plate 29 which is detachably attached to the sewing machine bed 4 as illustrated in FIG. 5 while the movable knife 26 is rotatably supported by the sewing machine body 30 by way of a pin 56 so as to face the stationary knife 25. The movable knife 26 is connected to a connecting link 58 by way of a pin 57 at the central portion thereof and the other end portion of the connecting link 58 is connected to one end portion of a swinging lever 27 by way of a pin 65, the swinging lever 27 being swingably supported by the sewing machine body 30 at the central portion thereof by way of a pin 59 as illustrated in FIG. 6, while the other end portion of the swinging lever 27 is connected to a thread trimming cam link 16 by way of the link mechanism 35 as illustrated in FIG. 7.

The link mechanism 35 is equipped with a bell crank 36 which is rotatably supported by the sewing machine body 30 by way of a pin 67 at the central portion thereof and a knife bar 45 which is connected to one end portion of the bell crank 36 by way of a pin while the other end portion of the bell crank 36 is connected to one end portion of a connecting link 69 by way of a pin 68 and the knife bar 45 is connected to the other end portion of the swinging lever 27 by way of a pin 66. The other end portion of the connecting link 69 is connected to the thread trimming cam link 16 together with the second thread trimming cam roller 16*a* by way of a pin. When the thread trimming cam link 16 turns clockwise about the pin 51, the swinging lever 27 turns counterclockwise by way of the connecting link 69, the bell crank 36 and the knife bar 45 in the direction of an arrow B illustrated in FIG. 6 so that the movable knife 26 turns counterclockwise by way of the connecting link 58 to manipulate the needle and bobbin threads, not shown, which pass through the needle hole 29*a* of the throat plate 29 and thereafter when the thread trimming cam link 16 turns counterclockwise about the pin 51, the movable knife 26 turns clockwise to its original position to trim the needle and bobbin threads cooperating with the stationary knife 25.

To put it concretely, since the first thread trimming cam roller 16*b* engages with the cam surface 20*a* by the resilience of the spring 19 in the state wherein the second thread trimming cam roller 16*a* is released from engaging with both cam surfaces 15*a* and 17*a* so that the thread trimming cam link 16 turns in accordance with the variation of the cam surface 20*a* of the thread trimming cam 20, the first thread trimming cam roller 16*b* can drive the movable knife 26 to manipulate the threads based on the turning of the thread trimming cam link 16 when the first thread trimming cam roller 16*b* moves toward the portion of the cam surface 20*a* where the radius of the thread trimming cam 20 is minimum, thereafter the movable knife 26 hooks the needle and bobbin threads and returns to its original position as the first thread trimming cam roller 16*b* returns to the portion of the cam surface 20*a* where the thread trimming cam 20 has a uniform and large radius and stops just before it trims the threads. At the same time the sewing machine stops its operation with the needle at its up position.

Successively, the clamp lifting cylinder unit 2 is operated forward in the state wherein the thread trimming cam roller 16*b* engages with the cam surface 20*a* as illustrated in FIG. 2 based on the thread trimming signal supplied by the control box 13 to turn the bell crank 38 and pull down the rod 21, so that the block 22 attached to the rod 21 at the central portion thereof pushes down the other end portion of the thread trimming lever 17, which turns clockwise against the resilience of the spring 18 so as to push up the second thread trimming cam roller 16*a* at the cam surface 17*a* thereof and consequently turns the thread trimming cam link 16 counterclockwise. The movable knife 26 is further turned clockwise to its original position by way of the link mechanism 35 based on the turning of the thread trimming cam link 16 so as to trim the sewing thread composed of the needle and bobbin threads cooperating with the stationary knife 25. The control box 13 produces this thread trimming signal based on the needle-up signal Nu produced by the needle position detector 8 as illustrated in FIG. 11.

At the same time, the bell crank 61 turns counterclockwise as the rod 21 is pulled down, which elevates the cloth clamp foot 3 by way of the link 62 so as to release the sewn product from being pressed and complete a cycle of sewing operation. The clamp lifting cylinder unit 2 and the thread trimming releasing cylinder unit 14 are connected to an air pressure source by way of an electromagnetic valve, not shown, to be operated forward and backward by energizing or de-energizing the solenoid of the electromagnetic valve.

The operation of the embodiment will be described hereinafter.

Before the start of sewing operation, the thread trimming releasing cylinder unit 14 and the clamp lifting cylinder unit 2 are operated forward so as to push up the second thread trimming cam roller 16*a* by the cam surface 17*a* of the thread trimming lever 17. Accordingly, the cam surface 20*a* of the thread trimming cam 20 is disengaged from the first thread trimming cam roller 16*b*. At this state, when the foot switch 1 is stepped down as far as the first step, the first switch SW1 is turned off and the clamp lifting cylinder unit 2 is operated backward based on the detecting signal of turning-off of the first switch SW1 as illustrated in FIG. 8 to push up the rod 21 so that the cloth clamp foot 3 lowers to clamp the sewn product on the sewing machine bed 4.

Figure 8:
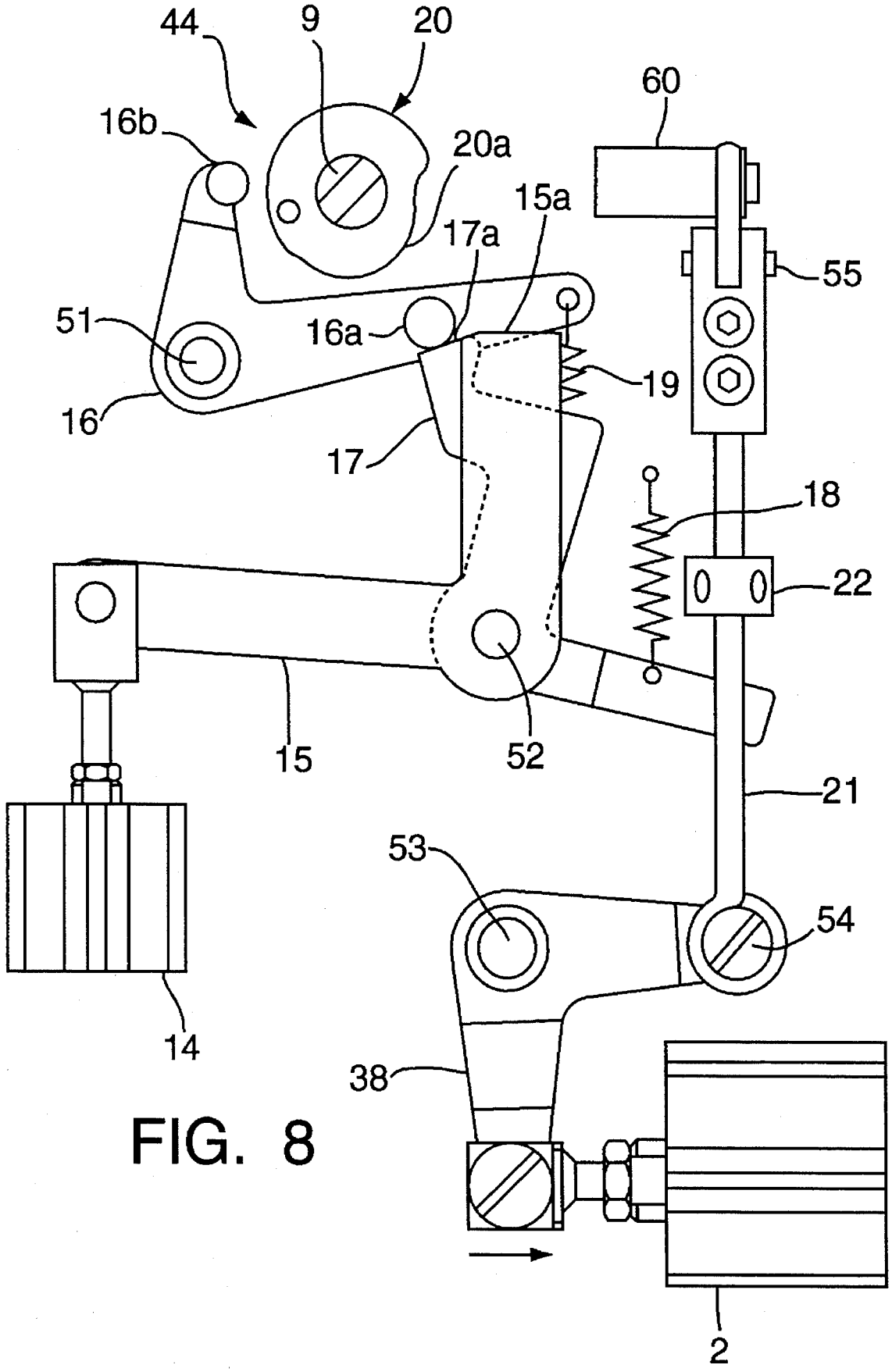
FIG. 8 is a view for explaining the operation of the thread trimming device in FIG. 1.

Meanwhile, when the rod 21 is pushed up by the backward operation of the clamp lifting cylinder unit 2 while the thread trimming releasing cylinder unit 14 is kept extended, the thread trimming lever 17 is released from being caught by the block 22 as illustrated in FIG. 8, but the cam surface 17*a* remains to be retained by the cam roller 16*a* due to friction therebetween against the resilience of the spring 18, and thereafter the thread trimming releasing cylinder unit 14 is operated backward so as to push up the second thread trimming cam roller 16*a* by the cam surface 15*a* of the thread trimming releasing lever 15 as illustrated in FIG. 9 so that the thread trimming lever 17 turns counterclockwise by the resilience of the spring 18. As a result, the cam surface 20*a* remains to be disengaged from the first thread trimming cam roller 16*b*.

When the foot switch 1 is further stepped down as far as the second step, the second switch is turned on and the driving motor starts rotation at low speed based on the detecting signal of turning on of the second switch. As a result, the arm shaft 9 is rotated by way of a belt 31 to start the rotation of the sewing machine to perform sewing at a low speed according to the feed pattern of the feed cam 6. When the driving motor 5 starts the low speed rotation, the needle 7 is at the up (stop) position as illustrated in FIG. 11, and thereafter the needle position detector 8 produces the needle-up signal Nu and needle-down signal Nd alternately and at a comparatively large time interval. Upon reception of a signal produced by the needle position detector 8, the driving motor 5 is switched to a high-speed after a given number of stitches are made, so that the arm shaft 9, i.e., the sewing machine is switched to the high-speed operation. At the same time, the first switch SW1 is returned to On state as illustrated in FIG. 11.

When a cycle of sewing operation draws to an end, the tongue 10*a* which serves as the detector of the detecting member 10 turns toward and faces the stop sensor 12 on the bracket 11 to produce a detecting signal (speed switching signal). Based on the detecting signal, the arm shaft rotating speed control unit 23 in the control box 13 produces a signal for indicating a low-speed rotation to the driving motor 5 so that the sewing machine is switched to the low-speed operation and stops when the needle 7 is at the up position after a given number of stitches are made.

The thread trimming operation is performed at the last stitch of a cycle of sewing operation. At the last stitch, the tongue 10*a* of the detecting member 10 turns toward the stop sensor 12 on the bracket 11 and comes closest to the stop sensor 12 to face the same. Then it goes away therefrom, when a detecting signal ON is transmitted to start thread trimming. The thread trimming releasing cylinder unit 14 is operated backward based on the detecting signal ON and the thread trimming releasing lever 15 fixed to the thread trimming releasing cylinder unit 14 turns counterclockwise, so that the thread trimming lever 17 which has been held by friction between the thread trimming cam roller 16*a* and itself is turned counterclockwise by the resilience of the spring 18 as illustrated in FIG. 9. As a result, the cam surface 15*a* is retained by the second thread trimming cam roller 16*a* to prevent the clockwise turning of the thread trimming cam link 16 caused by the resilience of the spring 19. The detecting signal ON which is produced when the tongue 10*a* of the detecting member 10 goes away from the stop sensor 12 serves as the thread trimming signal for starting the thread trimming at the last stitch of a cycle of sewing operation.

Then, the tongue 10*a* goes away sufficiently from the stop sensor 12, when the stop sensor 12 produces a detecting signal OFF to operate the thread trimming releasing cylinder unit 14 forward so that the thread trimming releasing lever 15 fixed to the thread trimming releasing cylinder 14 turns clockwise to release the cam surface 15*a* from being retained by the second thread trimming cam roller 16*a* as illustrated in FIG. 10. As a result, the thread trimming cam link 16 is turned clockwise by the resilience of the spring 19 to bring the first thread trimming cam roller 16*b* in contact with the thread trimming cam 20 fixed on the arm shaft 9. Since the thread trimming cam link 16 turns based on the variation of the cam surface 20*a* of the thread trimming cam 20 in synchronism with the rotation of the arm shaft 9 at the last stitch, the movable knife 26 is turned by way of the link mechanism 35 to manipulate the needle and bobbin threads and temporarily stops just before it trims the threads. When the movable knife 26 stops temporarily, the arm shaft 9, i.e., the sewing machine also stops with the needle 7 at its up position. When the arm shaft 9 stops, the tongue 10*a* of the detecting member 10 makes one revolution to return to the reference point A.

Successively, upon reception of the thread trimming signal (shown in FIG. 11) from the control box 13, the clamp lifting cylinder unit 2 is operated forward as illustrated in FIG. 2, so that the rod 21 is pulled down and the thread trimming lever 17 is turned clockwise against the resilience of the spring 18 by the block 22 fixed on the rod 21 connected to the clamp lifting cylinder unit 2 so as to push up the thread trimming cam roller 16*a* at the cam surface 17*a* of the thread trimming lever 17 and turn the thread trimming cam roller 16*a* counterclockwise. As a result, the movable knife 26 is operated by way of the link mechanism 35 to trim the sewing thread composed of the needle and bobbin threads cooperating with the stationary knife 25. When the rod 21 is pulled down, the bell crank 61 turns counterclockwise to lift the cloth clamp foot 3 by way of the link 62 so as to release the sewn product from being pressed and return to the original state completing a cycle of sewing operation.

Although the cam surface 17*a* of the thread trimming lever 17 pushes up the thread trimming cam roller 16*a* to turn the thread trimming cam link 16 counterclockwise for trimming the needle and bobbin threads by the movable and stationary knives 26 and 25 in the above embodiment, it is also possible to push out the first thread trimming cam roller

16*b* due to the shape of the cam surface 20*a* of the thread trimming cam 20 and operate the thread trimming unit 44 including the link mechanism 35 by the resulting turning of the thread trimming cam link 16 for the same purpose.

As understood from the above description, the thread trimming device for a lockstitch bar tacking sewing machine according to the present invention can obtain the following effects.

Since the operation of the thread trimming device starts on the basis of the thread trimming signal produced by the second position detecting means so that there is no need to provide a portion which is always sliding for the operation of the thread trimming device during a cycle of sewing operation, the mechanical components are simple in construction, easy in adjustment and the parts relating to thread trimming is improved in durability. Moreover, since the thread trimming starts at the last stitch of a cycle of sewing operation and the cam surface of the thread trimming cam can be released from being retained by the thread trimming cam link excepting the time of the thread trimming operation, the torque of the arm shaft is reduced and moreover, is equalized during a cycle of sewing operation. As a result, the sewing pattern in a cycle of sewing operation is made uniform, so that it is possible to finish a well-balanced sewn product.

What is claimed is:

1. A thread trimming device for a lockstitch bar tacking sewing machine comprising an arm shaft which is driven to rotate by a driving motor and is rotatably supported by a sewing machine body, a thread trimming cam which is fixed to the arm shaft for stopping the rotation of the arm shaft at a given position and performing thread trimming at the last stitch of a sewing cycle after a needle has made a given number of strokes to complete a cycle of sewing operation and a thread trimming cam link which is rotatably supported by the sewing machine body on the side thereof, characterized in that the thread trimming device further comprises:

a detecting member which has a detecting portion and is rotatably supported by said sewing machine body and which is driven to rotate at a reduced speed by the arm shaft, the detecting member interlocking the arm shaft so as to make one revolution during a cycle of sewing operation, a first position detecting means which is fixedly mounted on said sewing machine body in such a way as to be capable of facing said detecting portion of said detecting member and which produces a speed switching signal when said detecting portion approaches thereto, a second position detecting means which is fixedly mounted on said sewing machine body in such a way as to be capable of facing said detecting portion of said detecting member and which produces a thread trimming signal for starting the thread trimming when it detects the detecting portion at the last stitch of a sewing cycle, an arm shaft rotating speed control unit for controlling the rotating speed of said arm shaft by varying the rotating speed of said driving motor based on said speed switching signal produced by said first position detecting means; and a thread trimming unit comprising a driving unit for driving the thread trimming cam link so that the thread trimming cam link may come in contact with a cam surface of said thread trimming cam at a contact portion thereof for trimming said needle and bobbin threads based on said thread trimming signal produced by said second position detecting means.

2. A thread trimming device for a lockstitch bar tacking sewing machine according to claim 1, characterized in that said thread trimming unit comprises a movable knife which is driven to turn by way of turning said thread trimming cam link and a stationary knife which is fixedly mounted on said sewing machine body.

* * * * *